US006076608A

United States Patent [19]

MacDonald, III et al.

[11] Patent Number: 6,076,608

[45] Date of Patent: Jun. 20, 2000

[54] FIRE-SUPPRESSION SPRINKLER SYSTEM AND METHOD FOR INSTALLATION AND RETROFIT

[75] Inventors: Norman J. MacDonald, III, Lunenberg; Peter M. MacDonald, Boxboro, both of Mass.

[73] Assignee: PNM, Inc., Boxborough, Mass.

[21] Appl. No.: 09/076,078

[22] Filed: May 11, 1998

[51] Int. Cl.[7] ..... A62C 35/00

[52] U.S. Cl. ..... 169/16; 239/208; 239/209; 138/118; 52/168

[58] Field of Search ..... 169/16, 37; 239/208, 239/209; 138/118; 52/168; 354/63

[56] References Cited

U.S. PATENT DOCUMENTS

| | | | |
|---|---|---|---|
| 2,017,841 | 10/1935 | Coleman | 169/16 |
| 4,079,786 | 3/1978 | Moling | 169/16 |
| 4,361,189 | 11/1982 | Adams | 169/16 |
| 4,699,485 | 10/1987 | Lippman et al. | 354/63 |
| 4,834,186 | 5/1989 | Ballard | 169/37 |
| 5,097,906 | 3/1992 | Polan | 169/37 |
| 5,327,976 | 7/1994 | Hattori | 169/16 |
| 5,570,745 | 11/1996 | MacDonald, III | 169/37 |
| 5,682,925 | 11/1997 | Seckel | 138/118 |

FOREIGN PATENT DOCUMENTS

| | | | |
|---|---|---|---|
| 5137810 | 6/1993 | Japan | 169/37 |
| 6125999 | 5/1994 | Japan | 169/16 |

OTHER PUBLICATIONS

Flexible gas piping advertisement of Mestek Inc.

Tubing product information of Wirsbo Company.

TracPipe flexible gas piping advertisement of OmegaFlex, Inc.

Fire Sprinklers for Your Home, This Old House Magazine (Date Unknown).

*Primary Examiner*—Andres Kashnikow
*Assistant Examiner*—Dinh Q. Nguyen
*Attorney, Agent, or Firm*—Fish & Richardson P.C.

[57] ABSTRACT

A fire suppression sprinkler system and method for installing a sprinkler system in new and existing buildings. The system includes a manifold that supplies fire-suppression fluid to a set of wall-mounted sprinkler heads via flexible sprinkler head conduits through an unobstructed path. The installation and retrofit methods include determining the location of the sprinkler head, installing the manifold, making sure that there is an unobstructed path between the manifold and the sprinkler head location, running the conduit through the path by snaking it where necessary through the wall to which the sprinkler head is mounted, connecting the conduit to the manifold and sprinkler head, and then mounting the sprinkler head.

43 Claims, 3 Drawing Sheets

FIRE-SUPPRESSION SPRINKLER SYSTEM AND METHOD FOR INSTALLATION AND RETROFIT

BACKGROUND OF THE INVENTION

1. Field of the Invention

The present invention relates to fire suppression sprinkler systems, more particularly, to sprinkler systems that are relatively easy to install in new construction and to retrofit into existing construction.

2. The Prior Art

Most cities and towns require fire-suppression sprinkler systems in commercial and multi-family residential buildings, and more and more city and town fire codes are requiring fire suppression sprinkler systems to be installed in existing buildings, particularly when they are renovated. And increasing numbers of families, knowing of studies that show that sprinkler systems are effective in prevent injury and death due to fire, are having sprinkler systems installed into new houses and are having existing houses retrofitted. Conventional sprinkler systems are generally unsuited for installation in the typical house, particularly when the house is being retrofitted with a sprinkler system. Conventional sprinkler systems include a rigid, stationary fire-suppression fluid supply grid comprising a plurality of interconnected pipes rigidly supported above the ceiling. A plurality of sprinkler assemblages are connected to the fluid supply grid and have heat-sensitive sprinkler heads that extend through the ceiling into the room being protected.

There are situations when this rigid system is not feasible. For example, most two-story homes do not have enough space between stories to hold pipes supplying fluid to first-floor sprinkler heads. Even some single-floor houses do not have enough attic or crawl space to hold the pipes or to easily access the pipes when they are installed. As a result, the sprinkler heads are mounted high on the walls and fed from a basement grid, with the sprinkler heads being fed by rigid pipes extending inside the walls. When a house is being retrofitted, the walls must be torn out to install the pipes and then rebuilt, a very expensive and inconvenient process. Even in new residential and commercial constructions, the labor costs associated with installing large amounts of rigid pipe in the walls can be prohibitively expensive.

Consequently, there continues to exist a need for a method and the associated equipment to install fire suppression sprinkler systems in new homes and commercial construction and to retrofit existing construction that is convenient and fast relative to existing methods and equipment.

SUMMARY OF THE INVENTION

An object of the present invention is to provide a system and method for retrofitting an existing building with a fire-suppression sprinkler system that causes a minimum of disturbance in both time and construction to the building.

Another object is to provide a fire-suppression sprinkler system for installing into a new building or retrofitting an existing building that is much less labor-intensive than current systems.

Yet another object is to provide a relatively economical method for installing a fire-suppression sprinkler system into a new building.

A further object is to provide a relatively economical method for retrofitting an existing building with a fire-suppression sprinkler system.

The fire-suppression sprinkler system of the present invention includes a manifold that supplies fire-suppression fluid, typically water, to a set of sprinkler heads via flexible sprinkler head conduits through an unobstructed path. The construction of the manifold is well-known in the art and a typically includes a pressure gauge, a shut-off valve, a check valve, a flow detector that triggers an audible alarm, a secondary pressure gauge, an auxiliary shut-off valve, and an outlet that provides water to the conduits. The sprinkler head is a typical prior art, temperature-sensitive sprinkler head designed to be used in sprinkler systems and to be mounted on a wall. The sprinkler head is typically mounted high up on the wall to get the maximum dispersion of water. A typical mount includes a box that is recessed into the wall and a plate that is removably mounted to the box. The sprinkler head is mounted in an opening in the plate. The box includes an aperture for the conduit.

The conduit is a length of flexible hose with a connector at each end. One aspect of the present invention is the ability to retrofit a building with a minimum of disturbance. Another aspect is the ability to include a sprinkler system in a new building at minimal cost without sacrificing protection. A flexible conduit can be run or snaked through the hollow of a wall without having to open up the wall. All that is needed is an unobstructed path from the manifold to the sprinkler head. A flexible conduit can be bent as needed without the need for joints, which minimizes the opportunity for leaks and greatly reduces the amount of work necessary and the costs associated with such work.

There is a connector on each end of the hose to connect to the manifold and to the sprinkler head. One form of connector includes an internal thread in the conduit and a mating external thread on the manifold outlet and/or sprinkler head. Other common connectors include flared fittings, compression fittings, Victolic connectors, and grooved connectors, all well-known in the art.

The present invention includes a method for installing a fire-suppression sprinkler system in a building under construction. Steps include determining the location of the sprinkler head, installing the manifold, making sure that there is an unobstructed path between the manifold and sprinkler head location, running the conduit through the path, connecting the conduit to the manifold and sprinkler head, and then mounting the sprinkler head. This particular order of steps is merely illustrative.

The present invention also includes a method for retrofitting existing buildings with a fire-suppression sprinkler system. Steps include determining the location of the sprinkler head, installing the manifold, making sure that there is an unobstructed path between the manifold and sprinkler head location by removing or defeating any obstructions, running the conduit through the path by snaking it through the wall to which the sprinkler head is amounted, connecting the conduit to the manifold and sprinkler head, and then mounting the sprinkler head. As above, this particular order of steps is merely illustrative.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 2:
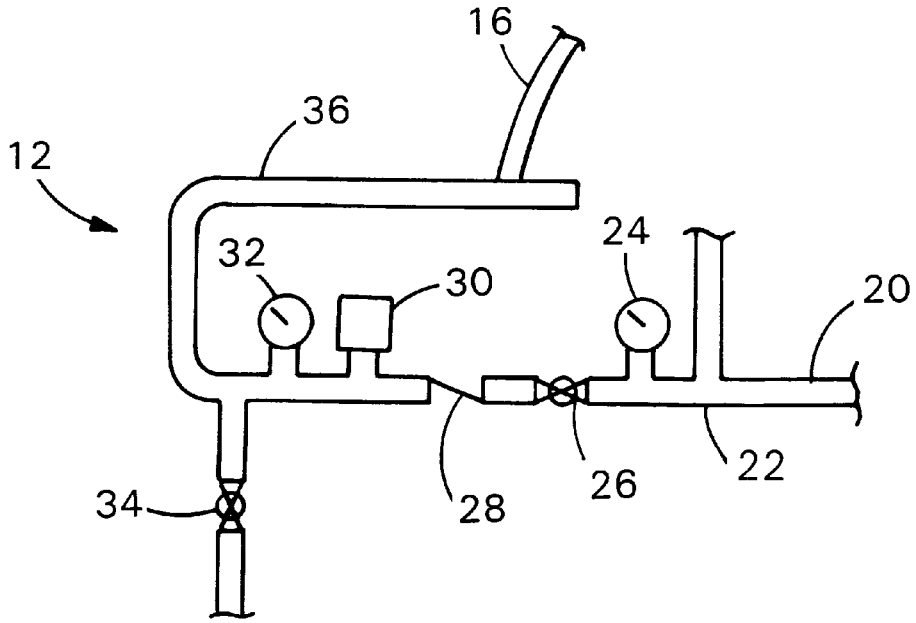
FIG. 2 is a schematic drawing of a manifold.

The fire-suppression sprinkler system 10 of the present invention includes a manifold 12 that supplies fire-suppression fluid, typically water, to a set of sprinkler heads 14 via flexible sprinkler head conduits 16 through an unobstructed path 18. The construction of the manifold 12 is well-known in the art and a typical manifold is shown in FIG. 2. The manifold 12 is supplied by water via a tap 22 off of the main water supply 20. A pressure gauge 24 indicates the pressure of the water in the main water supply. A shut-off valve 26 shuts off water pressure to the sprinkler system so that work may be performed on the system without interrupting water to the rest of the building. A check valve 28 prevents the back flow of water from the sprinkler system to the main water supply, eliminating the risk of stagnant and potentially contaminated sprinkler water mixing with drinking water. A flow detector 30 triggers an audible alarm if water flows through it, indicating that at least one of the sprinkler heads 14 has activated. A secondary pressure gauge 32 provides insurance against stuck or closed valves. An auxiliary shut-off valve 34 allows the sprinkler system 10 to be drained when maintenance is needed. The manifold outlet 36 provides water to the conduits 16. The manifold 12 may include a distribution grid of rigid pipes to which the conduits 16 are connected. The extent of the grid depends upon the size of the building and the amount of sprinkler coverage required.

Figure 4:
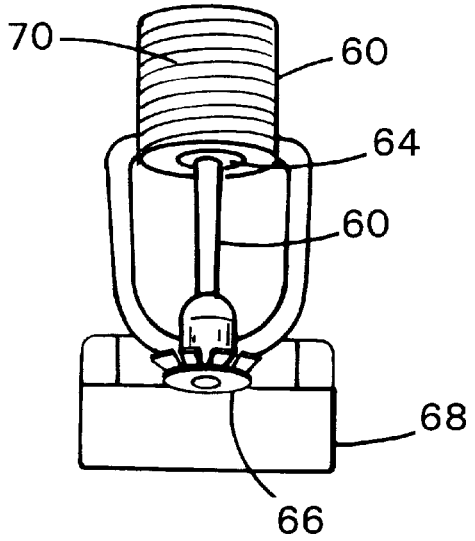
FIG. 4 is a perspective view of a sprinkler head.

The sprinkler head 14, as shown in FIG. 4, is a typical prior art, temperature-sensitive sprinkler head designed to be used in sprinkler systems. The sprinkler head 14 is provided with a length of cylindrical pipe 60 that is obstructed by a central plug 62. The plug 62 is held in place by a glass vial 64 of glycerin that expands when heated to break the vial 64 or by one or more links that are designed to melt at between about 130° F. and 212° F. When, due to heat and/or fire, the vial 64 breaks or the links melt, the plug 62 is dislodged from the pipe 60 by the force of the water acting against it. The water is dispersed over a large area by a dispersion device 66. A sprinkler head that is intended to be mounted on a wall generally includes a plate 68 that directs any upwardly-moving water back downward. The outer surface of the pipe 60 is threaded, as at 70, for connection to the conduit 16.

Figure 5:
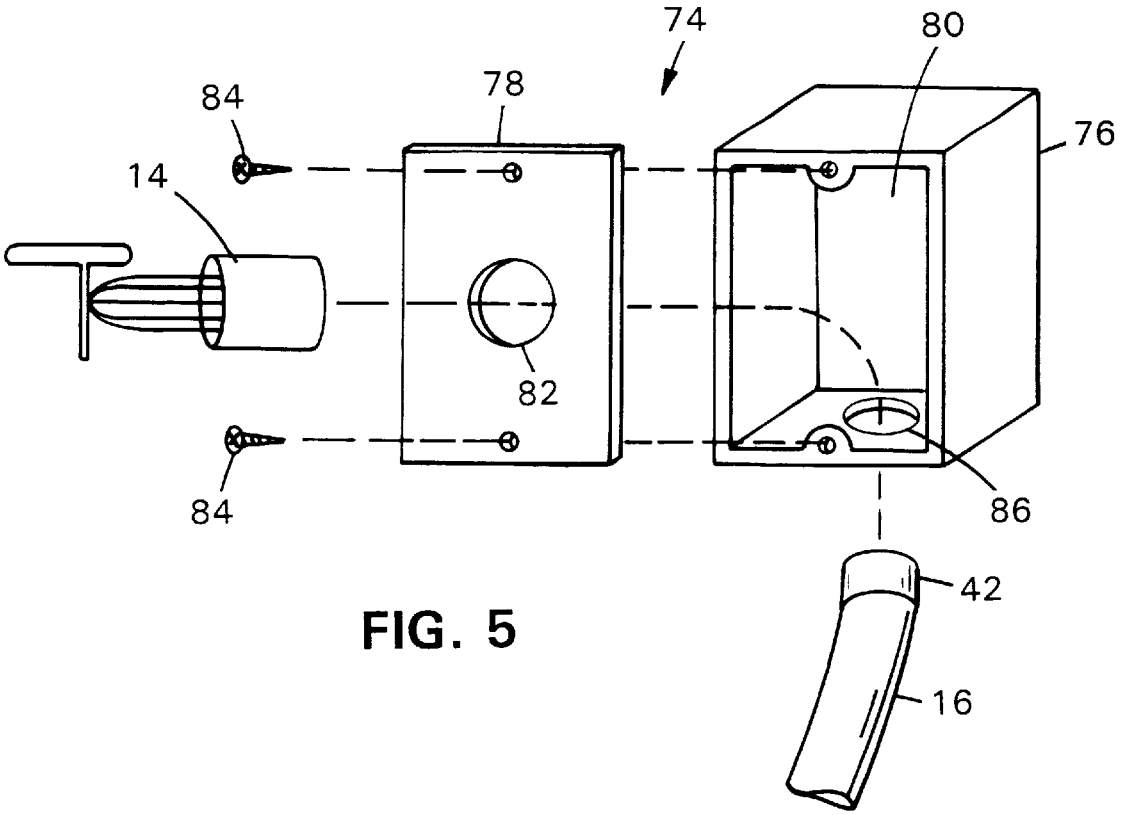
FIG. 5 is an exploded, perspective view of a sprinkler head wall mount.

The sprinkler head 14 is mounted to the wall 50 via a wall mount 74, typically high up on the wall 50 to get the maximum dispersion of water. A typical mount 74 is shown in FIG. 5, and includes a box 76 and a plate 78. The box 76 is recessed into the wall 50, with its open face 80 approximately flush with the wall 50. The sprinkler head 14 is mounted in an opening 82 in the plate 78 and the plate 78 attaches to the box 76, typically by a pair of removable screws 84. The conduit 16 runs through an aperture 86 in the box 76. The aperture 86 is preferably large enough so that the conduit 16 can be pulled through easily when the plate 78 is removed and pushed through easily when the plate 78 is installed.

Figure 1:
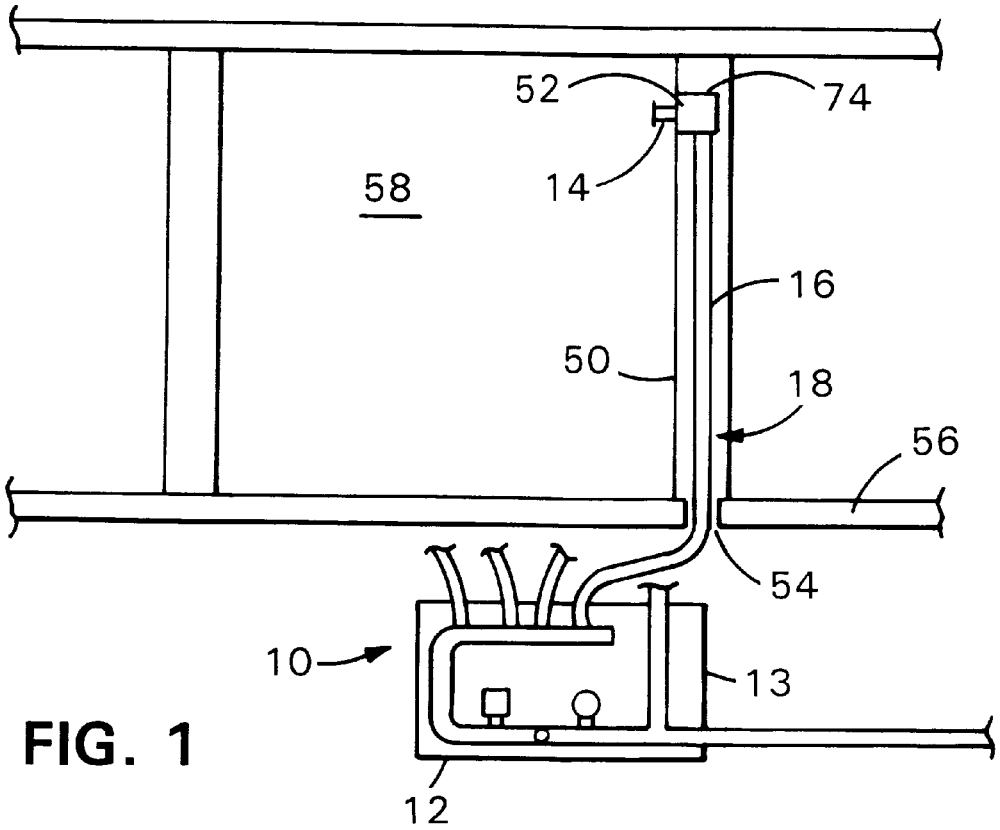
FIG. 1 is a cross-sectional view of a portion of a building showing the present invention.

The conduit 16 supplies water to the sprinkler head 14. The conduit 16 is a length of flexible hose 38 that has a connector 40, 42 at each end. One aspect of the present invention is the ability to retrofit a building with a minimum of disturbance. Another aspect is the ability to include a sprinkler system in a new building at minimal cost without sacrificing protection. As shown in FIG. 1, a flexible conduit 16 can be run through the hollow of a wall 50 without having to open up the wall 50, much in the same way that electrical wiring is installed. Generally, all that is needed is a hole 52 for the sprinkler head mount 74 and holes 54 in the horizontal wall studs 56 through which the conduit 16 passes so that there is an unobstructed path 18 from the manifold outlet 36 to the sprinkler head 14. Since the horizontal studs 56 are typically at the top and bottom of the wall 50, they are easily accessible for drilling the holes 54 through which the conduit 16 runs.

Also, a flexible conduit 16 can be routed as needed without the need for joints where the conduit 16 bends. Minimizing the number joints reduces proportionately the opportunity for leaks and it greatly reduces the amount of work necessary and the costs associated with such work.

A typical residential water supply provides between 60 and 100 pounds per square inch (psi) of water pressure. A typical commercial water supply provides sprinkler systems with pressures of about 175 psi. The flexible hoses for each system must be able to handle corresponding water pressures of at least these amounts, and preferably higher in the event there are pressure surges.

The hose 38 is designed to be resistant to kinking and damage during installation. Kinking is generally occurs when using a hose material that is too weak to prevent bending the hose in a tighter radius than it was designed for. A kink in the hose 38 will partially or completely block passage of water and prevent water from reaching the sprinkler head 14 with sufficient pressure. The hose for the present invention is preferably designed to have a minimum radius of approximately 1 to 12 inches and is strong enough to prevent bending beyond the minimum radius.

Damage is a weakening of the hose wall and can be caused by scrapes, cuts, and impacts during the installation process. It is especially possible in blind installation, such as when a conduit 16 is being snaked through walls, with no visibility into the wall. For example, the hose may snag on a nail that is extending into the wall. A damaged hose is more vulnerable to bursting from water pressure over an extended period of time, such as the long periods of time that the sprinkler system is active between tests of the system.

The hose 38 is also designed to be heat and smoke resistant, a necessity since the sprinkler system must operate during a fire. Materials used to make the hose 38 heat and smoke resistant include polymers, metals, and treated rubberized materials.

Figure 3:
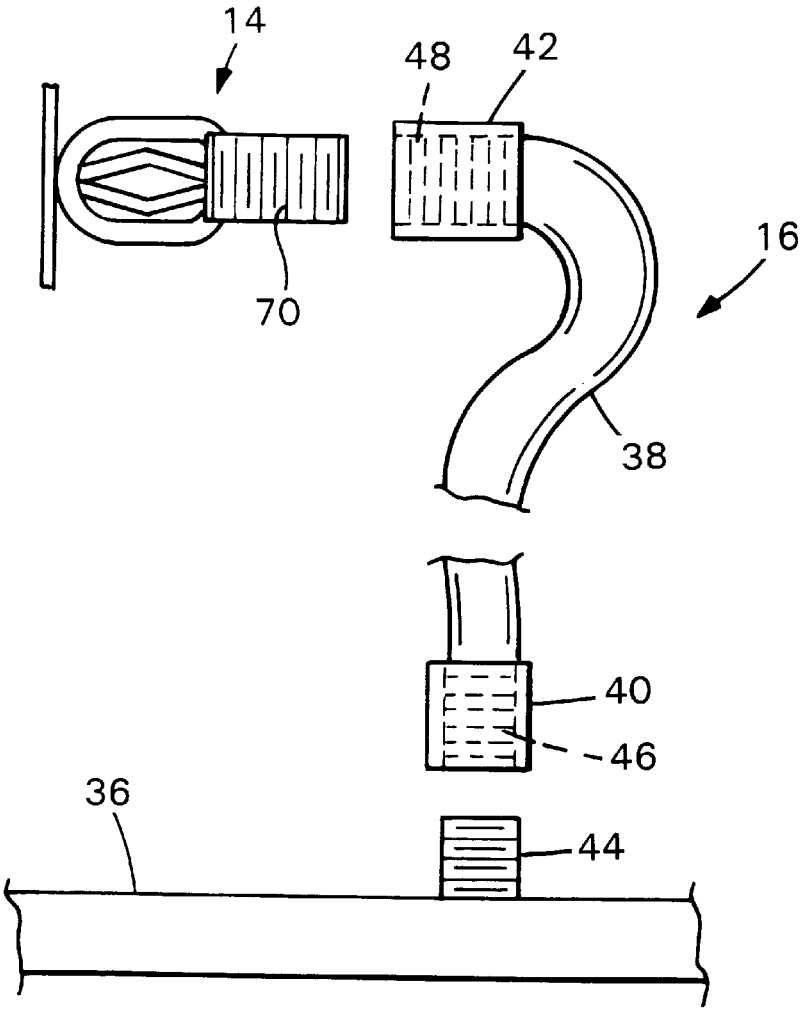
FIG. 3 is an exploded view of the conduit and connections.

As shown in FIG. 3, at one end of the hose 38 is a connector 40 to connect the conduit 16 to a manifold outlet 36 and at the other end of the hose 38 is a connector 42 for connection to the sprinkler head 14. It is also contemplated that a conduit may have more than one connector for connection to a sprinkler head. For example, if a single room needs two or more sprinkler heads, it may be easier and/or more economical to run a single flexible conduit from the manifold and put tee with a flexible conduit to each sprinkler head.

One form of connector 40, 42 includes an internal thread 46, 48 in the hose 38 adapted to accept an external thread 44 on the manifold outlet 36 or an external thread 70 on the sprinkler head 14. A gasket or other mechanism is employed to prevent water leaking at the connector. Other common connectors include flared fittings, compression fittings, Victolic connectors, and grooved connectors, all well-known in the art.

As indicated above, the present invention includes a method for installing a fire-suppression sprinkler system in a building under construction. At least one wall 50 of the room 58 to be protected must be hollow for the conduit 16. The first step is to install a manifold 12 so that it is connected to a supply of fire-suppression fluid, such as water. The next step is to make sure that there is a path 18 between the manifold 12 and each sprinkler head 14 location that will be unobstructed and invisible from the room when building construction is complete. If there are any potential obstructions, they are either removed or defeated in some other way. The obstruction typically encountered is the horizontal stud 56 at the top and/or bottom of the hollow wall 50, which is defeated by cutting a notch or drilling a hole 54 large enough for the conduit 16 to loosely fit through. Next, the conduit 16 is run through the unobstructed path 18. Then the conduit 16 is connected at one end to the manifold outlet 36 and the sprinkler head 14 is connected to the other end. Finally, the sprinkler heads 14 are installed on the hollow walls 50. The order described is not necessarily the order in which the steps are actually taken. The actual order is determined by the manner in which the building is constructed. For example, if the water supply is not yet available, most of the other steps may be performed before the manifold is connected to the water supply.

Also as indicated above, the present invention includes a method for retrofitting existing buildings with a fire suppression sprinkler system. At least one wall 50 of the room 58 to be protected must be hollow for the conduit 16. The first step is to install a manifold 12 so that it is connected to a supply of fire-suppression fluid, such as water. Then the sprinkler head 14 is installed on the hollow wall 50. The next step is to make sure that there is an unobstructed path 18 between the manifold 12 and each sprinkler head 14. The path is chosen so that the conduit 16 is not visible from within the room 58 when installation is complete. If there are any obstructions in the way, the obstructions are either removed or defeated in some other way. The obstruction typically encountered is the horizontal stud 56 at the top and/or bottom of the hollow wall 50, which is defeated by drilling a hole 54 large enough for the conduit 16 to loosely fit through. Next, the conduit 16 is snaked through the unobstructed path 18 by any means available, such as by using an electrician's snake to pull the conduit 16 the through the path from the manifold to the sprinkler head or from the sprinkler head to the manifold. Finally, the conduit 16 is connected at one end to the manifold outlet 36 and at the other end to the sprinkler head 14. The order of steps described is not necessarily the order in which the steps are actually taken. Any order that leads to the desired end result is contemplated. For example, it is generally more practical to snake the conduit 16 through the unobstructed path 18 and connect it to the sprinkler head 14 before mounting the sprinkler head 14 to the wall 50.

Thus it has been shown and described a fire-suppression sprinkler system which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A fire-suppression sprinkler system for protecting a room having a hollow wall, said system comprising:

a manifold operatively connected to a source of fire-suppression fluids said manifold having an outlet;

a sprinkler head for distributing the fire-suppression fluid over a desired area, the sprinkler head positioned remotely from the manifold and mounted on said hollow wall;

a fluid distribution path extending from the source of fire-suppression fluid to the remotely located sprinkler head; and a bendable, flexible conduit defining a substantial portion of the fluid distribution path and operatively connecting said sprinkler head to said manifold outlet, a portion of said fluid distribution path being within said hollow wall.

2. The fire-suppression sprinkler system of claim 1 wherein the room is within a residential building and said bendable, conduit is not visible from within said room.

3. The fire-suppression sprinkler system of claim 1 wherein said conduit is removably connected to said sprinkler head.

4. The fire-suppression sprinkler system of claim 1 wherein said sprinkler head is removably mounted to said hollow wall.

5. The fire-suppression sprinkler system of claim 1 wherein a substantial portion of said bendable, flexible conduit is within said hollow wall.

6. The fire-suppression sprinkler system of claim 1 wherein said conduit is kink-resistant.

7. The fire-suppression sprinkler system of claim 6 wherein said conduit has a minimum bend radius of between approximately one inch and approximately twelve inches.

8. The fire-suppression sprinkler system of claim 1 further comprising a mount including:

a housing defining an internal volume within which the sprinkler head is received, the housing having an aperture through which the flexible conduit extends to operatively connect to the sprinkler head and an open face; and a cover which covers the open face of the housing, the cover having an opening within which the sprinkler head extends.

9. The fire-suppression sprinkler system of claim 8 wherein the housing is configured to be positioned within a recess in a wall, such that the cover is substantially flush with the wall.

10. The fire-suppression sprinkler system of claim 1 wherein the flexible conduit is formed of a heat-resistant material.

11. The fire-suppression sprinkler system of claim 10 wherein the flexible conduit is formed of a smoke-resistant material.

12. The fire-suppression sprinkler system of claim 1 wherein the manifold includes a flow detector configured to trigger an audible alarm in response to the flow of fire-suppression fluid through the flow detector.

13. The fire-suppression sprinkler system of claim 1 wherein the manifold includes a check valve which prevents the back flow of fire-suppression fluid from the sprinkler system to a source of the fire-suppression fluid.

14. The fire-suppression sprinkler system of claim 1 wherein the bendable, flexible conduit is configured to allow flow of the fire-suppression fluid at levels of about 175 psi.

15. The fire-suppression sprinkler system of claim 1 wherein the bendable, flexible conduit is configured to receive a plurality of sprinkler heads.

16. The fire-suppression sprinkler system of claim 1 wherein the fluid distribution path extends through holes of a wall stud for supporting the hollow wall.

17. A method for installing a fire-suppression sprinkler system in a building under construction and having a room to be protected, said room having a hollow wall when construction is complete, said method comprising the steps of:

(a) operatively connecting a manifold to a supply of fire-suppression fluid at a manifold location, said manifold having an outlet;

(b) mounting a sprinkler head at a sprinkler head location on said hollow wall and remote from the manifold;

(c) providing a fluid distribution path between said supply of fire-suppression fluid and said sprinkler head location that is not visible from said room after construction is complete;

(d) running a bendable, flexible conduit along a substantial portion of said fluid distribution path;

(e) operatively connecting an end of said bendable, flexible conduit to said manifold outlet; and (f) operatively connecting another end of said bendable, flexible conduit to said sprinkler head.

18. The method of claim 17 wherein said sprinkler head is removably mounted to said hollow wall.

19. The method of claim 17 wherein said building is a residential building.

20. The method of claim 17 wherein a substantial portion of said conduit is within the hollow wall.

21. The method of claim 17 wherein said conduit is kink-resistant.

22. The method of claim 17 wherein mounting the sprinkler head further includes:

providing a housing defining an internal volume and having an open face and an aperture;

positioning an end of the flexible conduit through the aperture in the housing;

attaching the sprinkler head to the end of the flexible conduit and placing the sprinkler head within the internal volume of the housing;

providing a cover having an opening over the open face of the housing, the sprinkler head extending through the opening.

23. The method of claim 22 further comprising:

providing a recess within the hollow wall; and positioning the housing within the recess such that the cover is substantially flush with the wall.

24. The method of claim 17 further comprising forming the flexible conduit from a heat-resistant material.

25. The method of claim 17 further comprising forming the flexible conduit from a smoke-resistant material.

26. The method of claim 17 further comprising providing within the manifold a flow detector configured to trigger an audible alarm in response to the flow of fire-suppression fluid through the flow detector.

27. The method of claim 17 further comprising providing within the manifold a check valve which prevents the back flow of fire-suppression fluid from the sprinkler system to the supply of the fire-suppression fluid.

28. The method of claim 17 wherein the bendable, flexible conduit is configured to allow flow of the fire-suppression fluid at levels of about 175 psi.

29. A method for retrofitting an existing building with a fire-suppression sprinkler system, said building having a room to be protected and said room having a hollow wall, said method comprising the steps of:

(a) operatively connecting a manifold to a supply of fire-suppression fluid at a manifold location, said manifold having an outlet;

(b) mounting a sprinkler head at a sprinkler head location on said hollow wall and remote from the manifold;

(c) providing an fluid, distribution path between said supply of fire-suppression fluid and said sprinkler head location, said path not being visible from within said room;

(d) snaking a bendable, flexible conduit along a substantial portion of said fluid distribution path;

(e) operatively connecting an end of said bendable, flexible conduit to said manifold outlet; and (f) operatively connecting another end of said bendable, flexible conduit to said sprinkler head.

30. The method of claim 29 wherein holes are made in obstructions between said manifold location and said sprinkler head location to provide said unobstructed path.

31. The method of claim 30 wherein said conduit is kink-resistant.

32. The method of claim 30 wherein making holes in the obstructions to provide the unobstructed path includes making the holes in wall studs which support the hollow walls.

33. The method of claim 29 wherein said sprinkler head is removably mounted to said hollow wall.

34. The method of claim 29 wherein building is a residential building.

35. The method of claim 29 wherein substantially the entire length of said conduit is flexible.

36. The method of claim 29 wherein mounting the sprinkler head further includes:

providing a housing defining an internal volume and having an open face and an aperture;

positioning an end of the flexible conduit through the aperture in the housing;

attaching the sprinkler head to the end of the flexible conduit and placing the sprinkler head within the internal volume of the housing;

providing a cover having an opening over the open face of the housing, the sprinkler head extending through the opening.

37. The method of claim 36 further comprising:

providing a recess within the hollow wall; and positioning the housing within the recess such that the cover is substantially flush with the wall.

38. The method of claim 29 further comprising forming the flexible conduit from a heat-resistant material.

39. The method of claim 29 further comprising forming the flexible conduit from a smoke-resistant material.

40. The method of claim 29 further comprising providing within the manifold a flow detector configured to trigger an audible alarm in response to the flow of fire-suppression fluid through the flow detector.

41. The method of claim 29 further comprising providing within the manifold a check valve which prevents the back flow of fire-suppression fluid from the sprinkler system to the supply of the fire-suppression fluid.

42. The method of claim 29 wherein snaking the bendable, flexible conduit along a substantial portion of the fluid distribution path includes using a snake to pull the conduit through the hollow wall.

43. A fire-suppression sprinkler system for protecting a room having a hollow wall, said system comprising:

a manifold operatively connected to a source of fire-suppression fluid, said manifold having an inlet and an outlet, said manifold including:

an enclosure;

a conduit system disposed within the enclosure and extending between the inlet and outlet;

a flow detector disposed within the conduit system, the flow detector configured to trigger an audible alarm in response to the flow of fire-suppression fluid through the flow detector;

a check valve disposed within the conduit system, the check valve configured to prevent the back flow of fire-suppression fluid from the sprinkler system to the supply of the fire-suppression fluid;

a sprinkler head for distributing the fire-suppression fluid over a desired area, the sprinkler head positioned remotely from the manifold and mounted on said hollow wall;

a fluid distribution path extending from the source of fire-suppression fluid to the remotely-located sprinkler head, and a bendable, flexible conduit defining a substantial portion of the fluid distribution path and operatively connecting said sprinkler head to said manifold outlet, said conduit running through an unobstructed path from said manifold to said sprinkler head, a portion of said fluid distribution path being within said hollow wall.

* * * * *